US010576755B2

(12) United States Patent
Liow et al.

(10) Patent No.: US 10,576,755 B2
(45) Date of Patent: Mar. 3, 2020

(54) DOUBLE-SIDED PRINTER FOR PRINTING RECEIPTS ON THERMAL PAPER

(75) Inventors: Ridwan Liow, Singapore (SG); Chia Wei Hee, Singapore (SG)

(73) Assignee: Wincor Nixdorf International GmbH, Paderborn (DE)

( * ) Notice: Subject to any disclaimer, the term of this patent is extended or adjusted under 35 U.S.C. 154(b) by 1879 days.

(21) Appl. No.: 14/110,542

(22) PCT Filed: Apr. 11, 2012

(86) PCT No.: PCT/EP2012/056500

§ 371 (c)(1),
(2), (4) Date: Oct. 28, 2013

(87) PCT Pub. No.: WO2012/140030

PCT Pub. Date: Oct. 18, 2012

(65) Prior Publication Data

US 2014/0049592 A1 Feb. 20, 2014

(30) Foreign Application Priority Data

Apr. 11, 2011 (EP) ..... 11161874

(51) Int. Cl.
*B41J 3/60* (2006.01)
*B41J 2/32* (2006.01)

(52) U.S. Cl.
CPC .. *B41J 3/60* (2013.01); *B41J 2/32* (2013.01)

(58) Field of Classification Search
CPC ..... B41J 3/60; B41J 2/32; B41J 15/04; B41J 2202/31
See application file for complete search history.

(56) References Cited

U.S. PATENT DOCUMENTS 6,784,906 B2 8/2004 Long et al.
7,710,442 B2 5/2010 Lyons et al.
(Continued)

FOREIGN PATENT DOCUMENTS

EP 1321296 A2 6/2003
EP 2042327 A2 4/2009
(Continued)

OTHER PUBLICATIONS

International Preliminary Report on Patentability for International Application No. PCT/EP2012/056500 dated Oct. 30, 2013 (6 pages).
(Continued)

*Primary Examiner* — Huan H Tran
(74) *Attorney, Agent, or Firm* — Black, McCuskey, Souers & Arbaugh, LPA

(57) ABSTRACT

The invention relates to an arrangement for double-sided printing of thermal paper, with a first print head for printing the front side of the thermal paper and a second print head for printing the back side of the thermal paper. The arrangement comprises a first counter-pressure element lying opposite to the first print head and a second counter-pressure element lying opposite to the second print head, the thermal paper being guided between the first print head and the first counter-pressure element and between the second print head and the second counter-pressure element. A first unit is provided which can be moved relative to a second unit, the first print head being arranged in the first unit, and the second print head, the first counter-pressure element and the second counter-pressure element being arranged in the second unit.

15 Claims, 7 Drawing Sheets

(56) References Cited

U.S. PATENT DOCUMENTS

| | | | | |
|---|---|---|---|---|
| 8,139,093 | B2 * | 3/2012 | Koyabu | B41J 2/32<br>347/197 |
| 8,534,940 | B2 * | 9/2013 | Nagata | B41J 3/60<br>400/149 |
| 2007/0134039 | A1 | 6/2007 | Van Demark et al. | |
| 2008/0003038 | A1 * | 1/2008 | Nihashi | B41J 2/32<br>400/188 |
| 2008/0003039 | A1 * | 1/2008 | Sekino | B41J 3/60<br>400/188 |

FOREIGN PATENT DOCUMENTS

| | | | | |
|---|---|---|---|---|
| WO | WO 2010/070933 | * | 6/2010 | B41J 3/60 |
| WO | WO-2010-070933 | A1 | 6/2010 | |

OTHER PUBLICATIONS

International Search Report and Written Opinion (both in English) for PCT/EP2012/056500, dated Aug. 8, 2012; ISA/EP.

* cited by examiner

DOUBLE-SIDED PRINTER FOR PRINTING RECEIPTS ON THERMAL PAPER

CROSS-REFERENCE TO RELATED APPLICATIONS

This application is a National Stage of International Application No. PCT/EP2012/056500, filed Apr. 11, 2012, and published in English as WO 2012/140030 A1 on Oct. 18, 2012. This application claims the benefit and priority of European Application No. 11161874.0, filed Apr. 11, 2011. The entire disclosures of the above applications are incorporated herein by reference.

BACKGROUND

This section provides background information related to the present disclosure which is not necessarily prior art.

Technical Field

The invention relates to an arrangement for double-sided printing of thermal paper, comprising a first print head for printing the front side of the thermal paper and a second print head for printing the back side of the thermal paper.

Discussion

Printers of this type are in particular used as receipt printers, for example, for printing receipts in reverse vending machines or for printing cash register receipts in the retail trade. Further, receipt printers are used in various machines such as ticket machines, and systems for printing vouchers, tickets and receipts.

Thermal printers for double-sided printing of thermal paper are, for example, known from documents U.S. Pat. No. 7,710,442 B2, EP 1 321 296 A2 and U.S. Pat. No. 6,784,906 B2. In the known printers, the thermal paper is guided between a print head and a counter-pressure element so that the thermal paper rests against the respective print head for printing. In a maintenance mode, in particular for removing a paper jam or for inserting thermal paper unrolled from a roll into the printer, the print heads and the counter-pressure elements are separated from one another. In specific arrangements, a first print head and a first counter-pressure element are arranged in a lower first unit and a second print head and a second counter-pressure element are arranged in an upper second unit. The second unit is connected to the first unit in the form of a hinged cover so that when the cover is hinged open, the print heads and the counter-pressure elements are separated from one another so that the thermal paper can easily be inserted and/or can easily be removed in the area of the print heads.

The first print head and the second counter-pressure element are arranged opposite to each other and form a first printing mechanism. The second print head and the first counter-pressure element form a second printing mechanism. As a result thereof, the print heads and counter-pressure elements belonging to one printing mechanism are held in different units so that the printing quality of the print image generated with the aid of these printing mechanisms is highly dependent on the exact positioning of the two units to each other.

SUMMARY OF THE INVENTION

It is an object of the invention to specify an arrangement for double-sided printing of thermal paper by which a high printing quality of at least one print image generated with the aid of this arrangement is achieved.

In the inventive arrangement, both the second print head and the second counter-pressure element are arranged in the second unit so that the positioning of these two component parts is not dependent on the position of the first unit relative to the second unit, as a result whereof the position of the second print head relative to the second counter-pressure element can be exactly defined and a high-quality print image can be generated on the thermal paper to be printed with the aid of the second print head. Preferably, the print image is generated with the aid of a direct thermal printing process on the thermal paper.

In a development of the invention, the counter-pressure elements, which are often also referred to as platens, are designed as counter-pressure rollers. As a result thereof, the thermal paper can be easily guided through the arrangement during a printing operation.

Further, it is advantageous when the counter-pressure rollers are driven in opposite rotation directions relative to each other at the same speed. As a result thereof, the driven counter-pressure rollers can exert a force on the thermal paper in the transport direction in which the thermal paper can be transported through the arrangement during a printing operation. As a result thereof, the thermal paper can be driven without further drive elements at least in the area of the print heads. However, additionally or alternatively, also other drive elements can be provided for driving the thermal paper, such as at least one roller pair having at least one driven roller.

Further, it is advantageous when each print head comprises at least one thermal line with the aid of which the thermal paper can change its color selectively in a point-by-point manner by heating the thermal paper. With the aid of such a thermal line, a print image can easily be generated on a suitable thermal paper in the direct thermal printing process, without further consumables being necessary apart from the thermal paper. As a result thereof, the maintenance requirements for devices for direct thermal printing are relatively low and are usually restricted to the replacement or the refilling of the thermal paper. The thermal paper is supplied to the device in particular in the form of a thermal paper roll from which the thermal paper to be printed is unrolled for and during printing.

In a further preferred embodiment of the invention, at least one element exerting a pressure force on the print head in the direction of the counter-pressure element lying opposite to the respective print head is associated with each printer. Thus, the thermal paper arranged between the print head and the counter-pressure element is pressed against the counter-pressure element on one side. On the other side of the thermal paper, the thermal line of the print head is pressed against the surface of the thermal paper. In this way, it is guaranteed that the thermal line reliably rests against the thermal paper in the printing operation.

In a development of the invention, the first unit and the second unit have a first position relative to each other in a print mode and a second position relative to each other in a maintenance mode. As a result thereof, the first counter-pressure element and the first print head can easily be arranged in a printing position in the print mode and in a maintenance position in the maintenance mode. In the printing position, the print head arranged in the first unit is pressed against the first counter-pressure element or rather against the thermal paper arranged between the first print head and the first counter-pressure element. In the maintenance mode, the first print head and the first counter-pressure element are spaced from each other so that a thermal paper arranged between the first print head and the first counter-pressure element in the print mode can easily be removed. Preferably, the first print head and the first counter-pressure element are spaced from each other in the maintenance position such that a person can easily access the first print head and/or the first counter-pressure element.

Here, it is advantageous when a pressure force between the first counter-pressure element and the first print head in the maintenance mode is reduced compared to the pressure force between the first counter-pressure element and the first print head in the print mode. Alternatively or additionally, the pressure force between the second counter-pressure element and the second print head in the maintenance mode is reduced compared to the pressure force between the second counter-pressure element and the second print head in the print mode. In this way, it is guaranteed that the thermal paper arranged between the print heads and the counter-pressure elements rests reliably against the thermal line of the print head in the print mode, and that the thermal paper can easily be removed from the arrangement and/or thermal paper of a new thermal paper roll can easily be guided through the arrangement and thus be inserted into the arrangement in the maintenance mode, without a pressure force being exerted between the counter-pressure elements and the opposite print heads during the insertion of the thermal paper.

Further, in this development of the invention it is advantageous when the second counter-pressure element can be removed from the second unit in the maintenance mode without further operator actions being required for this. As a result thereof, the thermal paper present between the second print head and the second counter-pressure element in the print mode can easily be accessed and thus, for example, paper jams or the like can be removed.

In a further advantageous development, the position of the first unit relative to the second unit is fixed with the aid of a locking element in the print mode. Here, a pressure force can be exerted between the first counter-pressure element and the first print head as well as between the second counter-pressure element and the second print head. The first counter-pressure element is held in a predetermined position in the second unit with the aid of the first unit. As a result thereof, an easy fixing of the first counter-pressure element is possible in the print mode, without additional operator actions being required for this. It is only necessary to bring the first and the second unit into the printing position assumed in the print mode.

Further, it is advantageous to provide guiding means for guiding the first unit when moving the first unit between its first position and its second position. As a result thereof, the possible relative motion between the first and the second unit is limited, and by way of the guiding with the aid of the guiding means also untrained and inexperienced people can safely move the units from their printing position into their maintenance position, and vice versa.

Further, it is advantageous when the guiding means comprise at least one hinge to allow a pivot motion between the first unit and the second unit. Alternatively or additionally, the guiding means can comprise the combination of at least one oblong hole and at least one engagement element engaging with the oblong hole. As a result thereof, simply structured and robust guiding means that can easily be integrated into the arrangement are provided.

It is particularly advantageous when the oblong hole has a first leg and a second leg, the two legs being arranged in an obtuse, acute or right angle with respect to each other and each of the two legs comprising a first end region at which they are connected to each other as well as a second end region. Further, means are provided which hold the engagement element connected to the first unit in the second end region of the first leg of the oblong hole in the maintenance mode. If several oblong holes are provided for engagement with one engagement element each, said means hold the engagement elements connected to the first unit each time in a second end region of the first leg of the respective oblong hole in the maintenance mode. In this way, it is guaranteed that the units remain in their relative position to each other in the maintenance mode and do not return into the printing position inadvertently.

The second counter-pressure element comprises a first end region and a second end region. The first end region is opposite to the second end region. Between the two end regions, a third region is provided on which a pressure force is exerted by the second print head in the print mode. Each of the first and the second end regions of the counter-pressure element can be received in an opening provided in a chassis of the second unit, each of the openings being open at the side facing the first unit in the print mode. By way of this structure, the second counter-pressure element can easily be removed from the slots and thus from the second unit and thus in turn from the entire arrangement without further operator actions or any assembly work being required for this.

Preferably, a bearing unit is provided at each end region of the second counter-pressure roller. In the print mode, each of the bearing units is received in one of the openings. As a result thereof, the rollers which are received in the openings can easily rotate about their axes of rotation.

Further, it is advantageous when each bearing unit comprises a first bearing element that can be received in a chassis of the arrangement and at least one second bearing element, at the circumferential surface of which a groove is provided into which the sides delimiting a slot in a guiding element for guiding the movement of the print head can be received. The combination of groove and slot allows a relative motion of the slot or, respectively, of the guiding element with respect to the second bearing element, the guiding element being firmly connected to a print head. As a result thereof, a relative motion of the print head with respect to the opposite counter-pressure element is possible, which relative motion is guided by at least two guiding elements firmly connected to the print head. In this way, it can be guaranteed that it is the thermal line of the print head which is pressed against the opposite counter-pressure roller and not any other region of the print head. As a result thereof, it is guaranteed that the thermal paper safely rests against the thermal line during the printing operation and a high-quality print image can be generated.

BRIEF DESCRIPTION OF THE DRAWINGS

The drawings described herein are for illustrative purposes only of selected embodiments and not all possible implementations, and are not intended to limit the scope of the present disclosure.

Further features and advantages of the invention result from the following description which explains the invention in more detail with reference to embodiments in connection with the enclosed figures.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
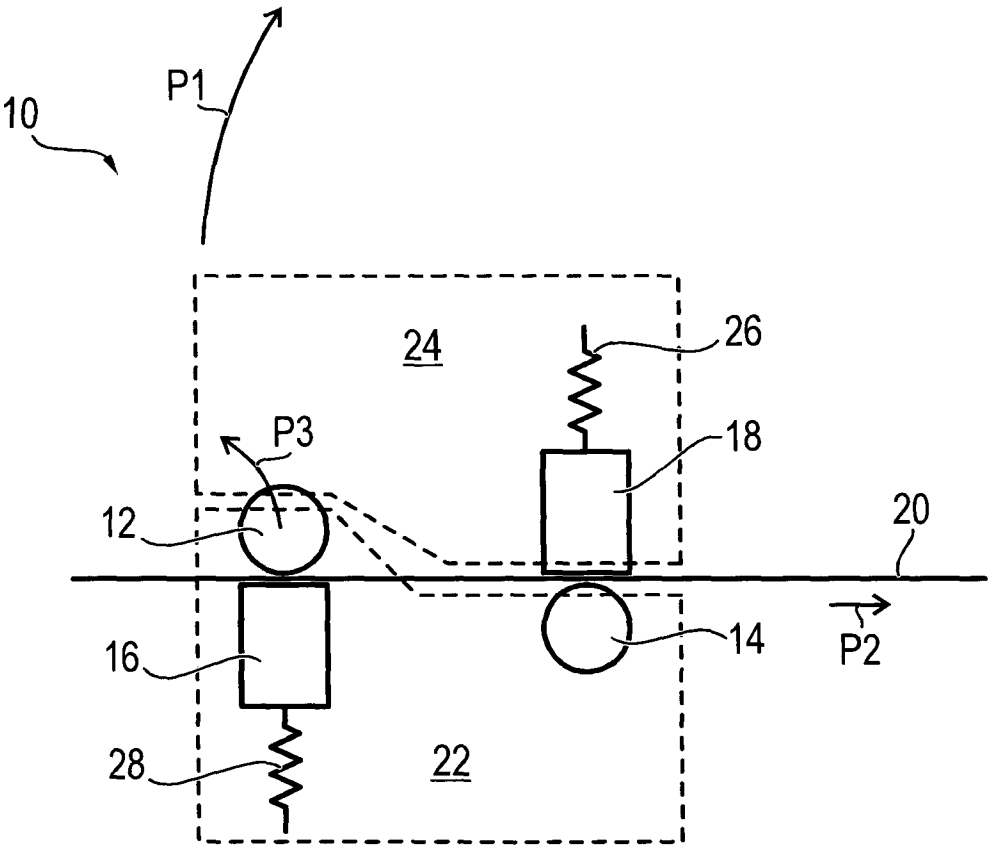
FIG. 1 shows a schematic illustration of a printing module for double-sided printing of thermal paper according to a first embodiment of the invention.

FIG. 1 shows a schematic illustration of a printing module 10 for double-sided printing of thermal paper 20. The printing module 10 comprises a first unit 24 and a second unit 22. The first unit 24 can be moved relative to the second unit 22. In particular, the position of the first unit 24 relative to the second unit 22 can be changed by pivoting the first unit 24 about an axis of rotation.

The first unit 24 comprises a first print head 18 which is spring-mounted with the aid of a first spring element 26. The second unit 22 comprises a first counter-pressure roller 14 which is arranged opposite to the first print head 18 in a print mode with respect to a transport path of the thermal paper 20. Further, the second unit 22 comprises a second print head 16 and a second counter-pressure roller 12 opposite to the second print head 16 with respect to the transport path. The second print head 16 is mounted on a second spring element 28 which exerts a pressure force on the second print head 16 in the direction of the second counter-pressure roller 12. In the print mode, a thermal paper 20 to be printed is guided between the first print head 18 and the first counter-pressure roller 14 lying opposite thereto as well as between the second print head 16 and the second counter-pressure roller 12 lying opposite thereto. The two print heads 16, 18 are positioned on opposite sides of the thermal paper 20 such that the front side and the back side of the thermal paper 20 are each guided past one of the print heads 16, 18. For a selective printing of the thermal paper 20 in a point-by-point manner, each print head 16, 18 comprises at least one so-called thermal line for heating the thermal paper 20.

The counter-pressure rollers 12, 14 are driven with the aid of a drive unit and exert a driving force in the direction of the arrow P2 on the thermal paper 20 during the printing operation. Additionally or alternatively, further transport means for transporting the thermal paper 20 can be provided, such as at least one driven roller pair, between the rollers of which the thermal paper 20 is guided. In a specific embodiment of the printing module 10, the thermal paper 20 can be transported with the aid of the counter-pressure rollers 12, 14 and/or the at least one further roller pair also in a direction opposite to the arrow P2. The printing module 10 comprises a drive unit which drives the counter-pressure rollers 12, 14 at the same rotational speed in opposite directions relative to each other for transporting the thermal paper 20 in the direction of the arrow P2. The drive unit preferably comprises a stepper motor. Further, the counter-pressure rollers 12, 14 are provided with such a surface that the frictional forces acting between the thermal paper 20 and the two counter-pressure rollers 12, 14 are higher than the frictional forces between the thermal paper 20 and the print heads 16, 18. In order to guarantee the transport of the thermal paper 20, the counter-pressure rollers 12, 14 may, for example, have a rubberized surface in a preferred embodiment.

In the print mode, the first print head 18 prints a first side of the thermal paper 20 and the second print head 16 prints a second side of the thermal paper 20 lying opposite to the first side. The print heads 16, 18 press the thermal paper 20 against the counter-pressure rollers 12, 14 so that the thermal paper 20 lies flat against the thermal lines of the print heads 16, 18. As a result thereof, a high-quality print image can be generated on both sides of the thermal paper 20.

In addition to the print mode, a maintenance mode is provided. When changing from the print mode to the maintenance mode, the first unit 24 is moved in the direction of the arrow P1 relative to the second unit 22. Thus, the second counter-pressure roller 12 is no longer held in its position in the second unit 22 by the first unit 24 and can be removed from the second unit 22 in the direction of the arrow P3. Subsequently, the thermal paper 20 can easily be accessed in the area of the print heads 16, 18 and a malfunction, such as a paper jam, can be removed without much effort.

Figure 2:
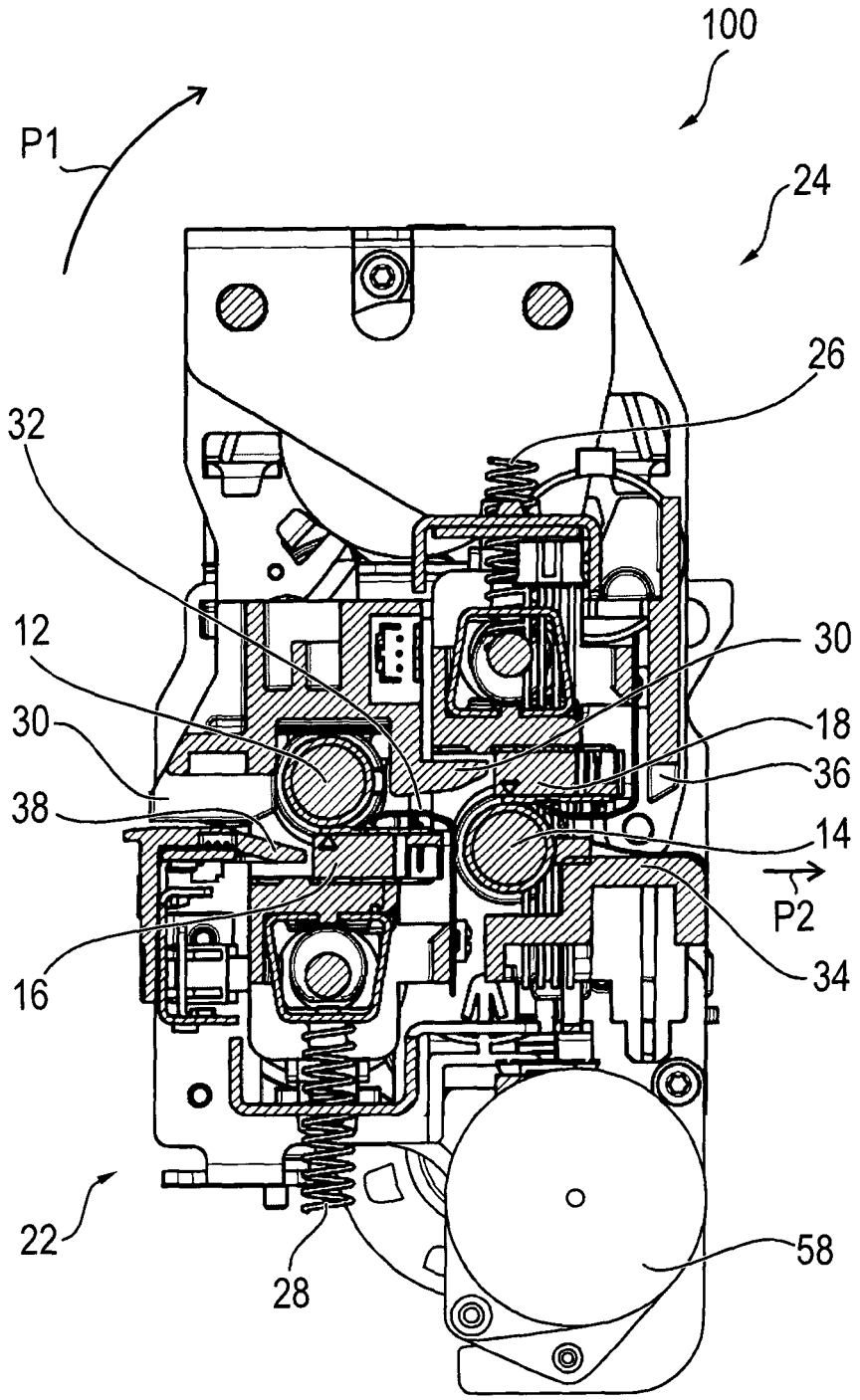
FIG. 2 shows a cross-sectional side view of a printing module according to a second embodiment of the invention in a print mode.

FIG. 2 shows a partially sectional side view of a printing module 100 of a specific embodiment of the invention in the print mode. Elements having the same structure or function are identified with the same reference signs, as this is also the case in the further figures. A drive motor 58 which is coupled to the counter-pressure rollers 12, 14 via a gear stage serves to drive the counter-pressure rollers 12, 14. Guiding elements 30, 32, 34, 36 delimit the path of the thermal paper 20 through the printing module 100. For reasons of clarity, the thermal paper 20 is neither illustrated in FIG. 2 nor in the further figures.

Figure 3:
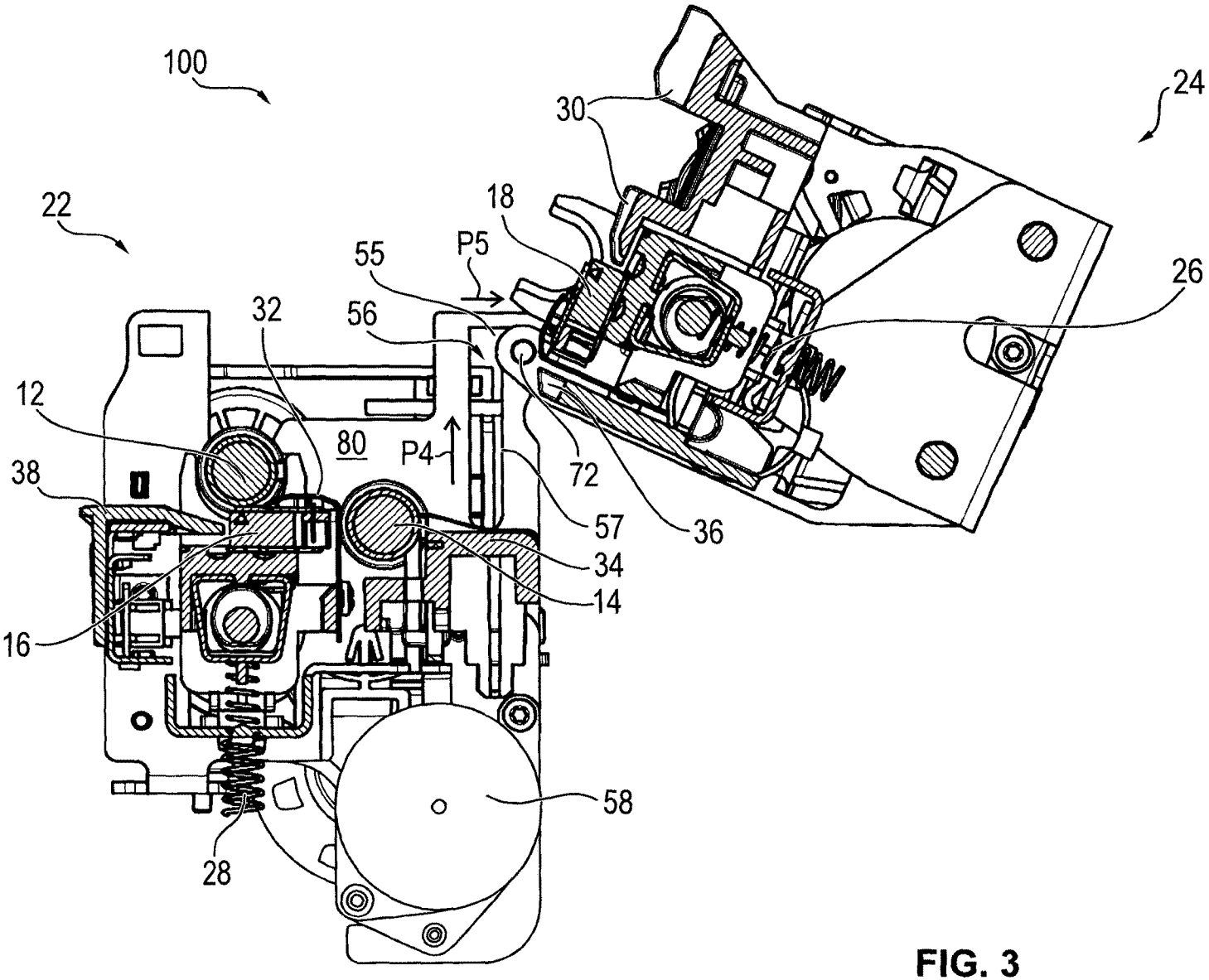
FIG. 3 shows a cross-sectional side view of the printing module according to FIG. 2 in a maintenance mode.

FIG. 3 shows the printing module 100 according to FIG. 2 in the maintenance mode. For changing from the print mode to the maintenance mode, i.e. from the printing position of the units 22, 24 illustrated in FIG. 2 to the maintenance position illustrated in FIG. 3, the first unit 24 has been displaced along an oblong hole guide 56 provided in a first chassis 80 of the second unit 22. The oblong hole guide 56 has a first leg 57 and a second leg 55 which are connected to each other at one end and are angled relative to each other. For displacement of the first unit 24 from the printing position into the maintenance position, the first unit 24 is guided in the direction of the arrow P4 along the first leg 57 of the oblong hole guide 56 via a pin 72 projecting from the first unit 24 into the oblong hole guide 56, is laterally displaced in the direction of the arrow P5 along the second leg 55 of the oblong hole guide 56 and is pivoted about an axis of rotation formed by the longitudinal axis of the pin 72. As a result thereof, the second counter-pressure roller 12 is no longer held by means of the first unit 24 in its printing position in the second unit 22 and can be removed therefrom and thus also from the printing module 100. By moving the first unit 24 from the printing position into the maintenance position, the second counter-pressure roller 12 only rests loosely on the thermal paper 20 or, respectively, on the second print head 16 so that a pressure force is present between the second print head 16 and the second counter-pressure roller 12 that is reduced compared to the print mode.

Figure 4:
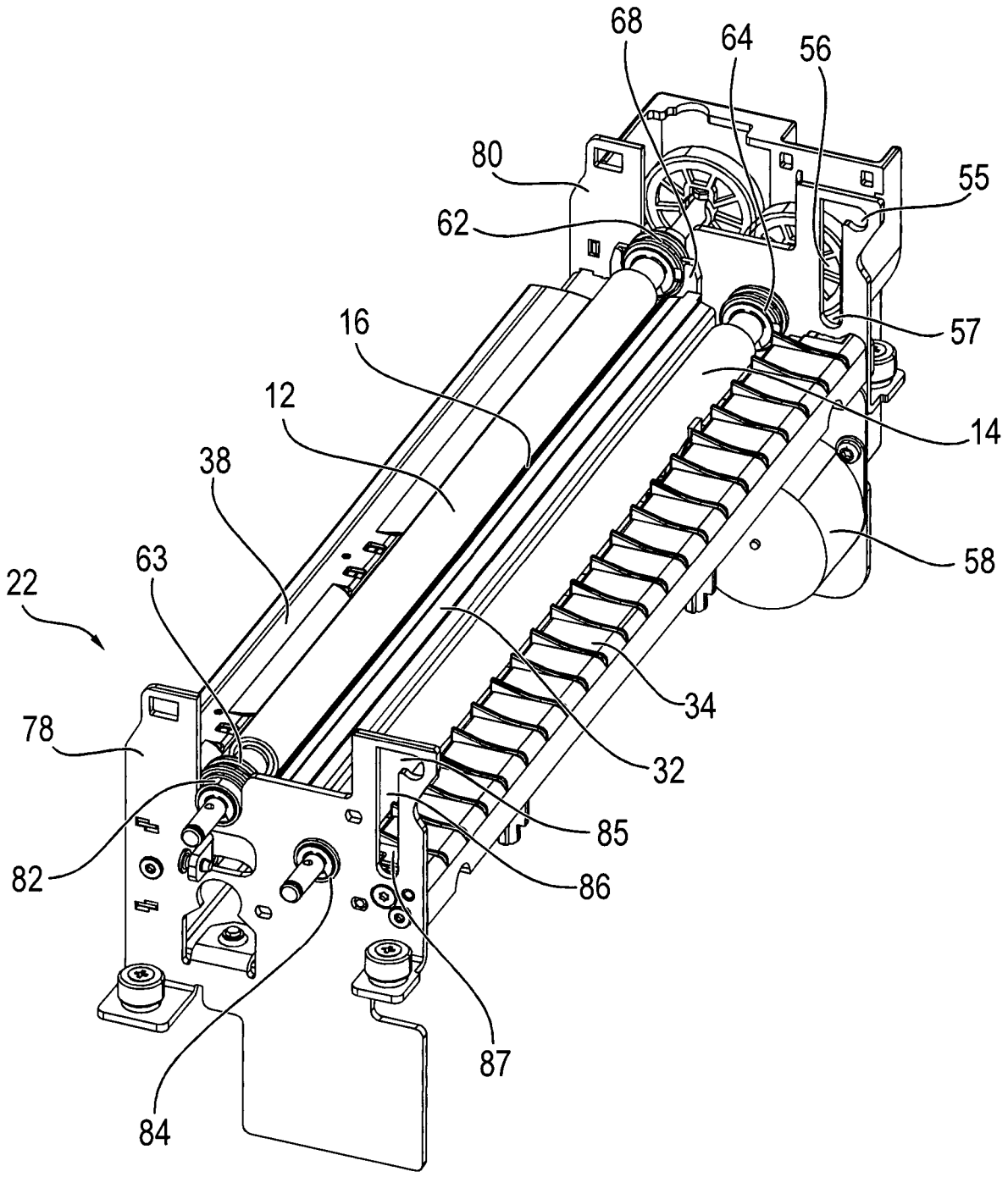
FIG. 4 shows a perspective view of a second unit of the printing module according to FIGS. 2 and 3.

In FIG. 4, a perspective illustration of the second unit 22 is shown. In addition to the first chassis 80, a second chassis 78 of the second unit 22 is illustrated in FIG. 4. In the second chassis 78, a second oblong hole guide 86 is provided which is formed and arranged mirror-symmetrically with respect to the first oblong hole guide 56 in the first chassis 80. The normal vector of the mirror plane of symmetry of the mirror-symmetrical arrangement of the oblong hole guides 56, 86 runs parallel to the axes of rotation of the counter-pressure rollers 12, 14. Preferably, a longitudinal axis of the widest thermal paper 20 to be printed lies in the plane of symmetry.

Figure 6:
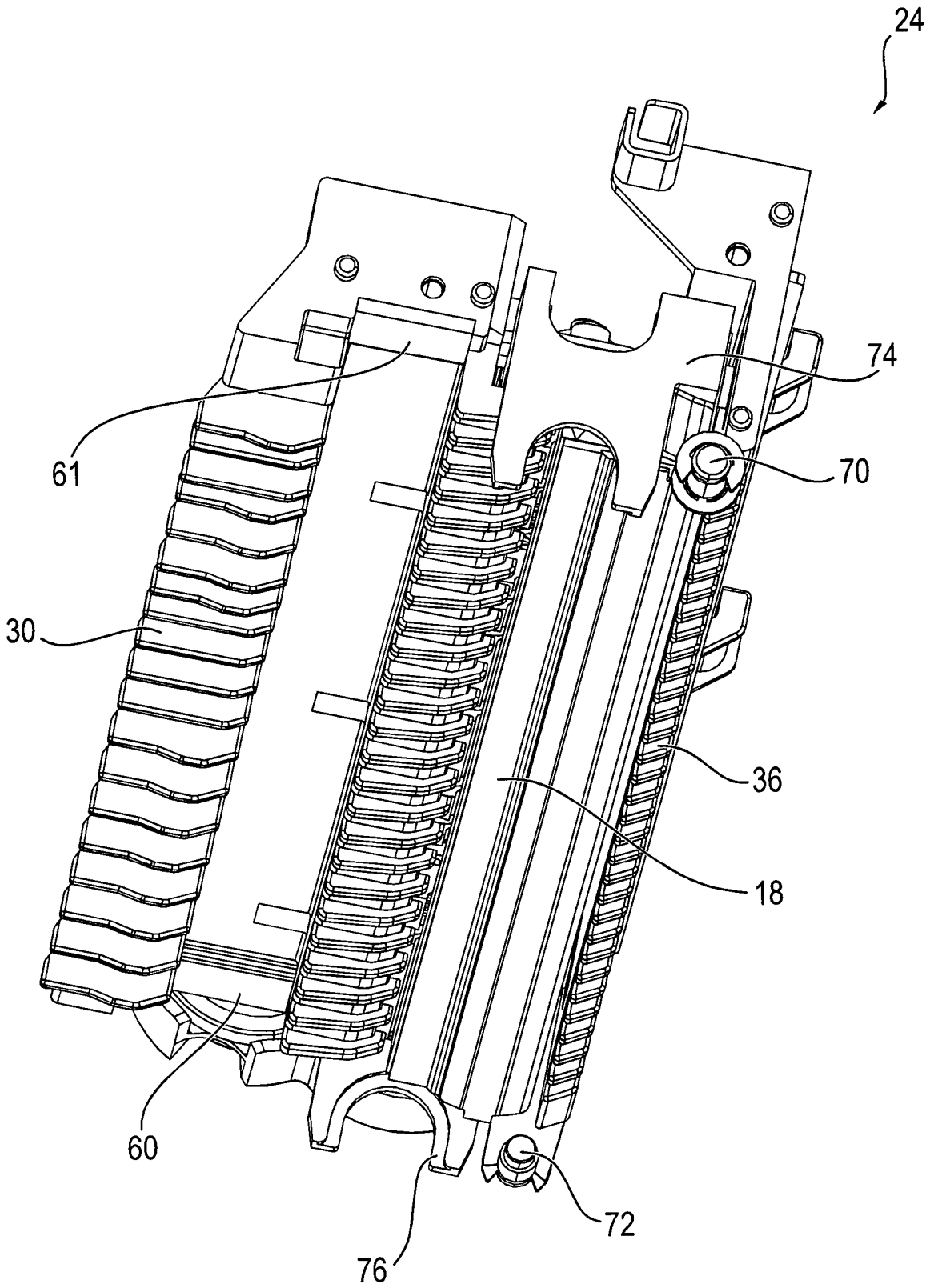
FIG. 6 shows a perspective view of a first unit of the printing module according to FIGS. 2 to 5.

At each end region of each counter-pressure roller 12, 14 a bearing unit is provided outside of the contact area contacting the thermal paper 20 in the print mode. Each of these bearing units comprises a first bearing 82, 84 and a second bearing 62, 63, 64. The second bearing 62, 63, 64 serves as an axial guide bearing and is located between the contact area and the first bearing. The first bearing 82, 84 serves to mount one end of the counter-pressure rollers 12, 14 in the chassis 78, 80 of the second unit 22. The second bearing 62, 63, 64 serves to couple the end regions of the respective counter-pressure roller 12, 14 to the print head 16, 18 lying opposite to the counter-pressure roller 12, 14. One guiding element 66, 68, 74, 76 each which is shown in FIG. 6 and which is firmly connected to the first print head 16 or, respectively, the second print head 18 can be engaged with the second bearings 62, 63, 64 so that a relative motion between the print head 16, 18 and the counter-pressure roller 12, 14 is guided via the engagement between the guiding elements 66, 68 and the second bearing 62, 63, 64. The first bearings 82, 84 received in the second chassis 78 and the first bearings received in the first chassis allow a rotation of the counter-pressure rollers 12, 14 about their axes of rotation in the chassis 78, 80. The second bearings 62, 63, 64 allow a rotation of the counter-pressure rollers 12, 14 relative to the guiding elements 66, 68.

Further, limiting elements 32, 34, 38 are provided which extend over the maximally intended width of the thermal paper 20 to be printed. Together with the limiting elements 30, 36 shown in FIG. 6, they delimit the paper path of the thermal paper 20 through the printing module 100. The two limiting elements 32 and 38 are provided with a smooth surface, whereas the limiting elements 30, 34, 36 have a surface formed by longitudinal ribs. The limiting elements 30 to 38 are arranged such that each time a limiting element having a ribbed surface and a limiting element having a smooth surface are arranged opposite to each other in the print mode, and the thermal paper 20 is arranged between the surfaces of the limiting elements 30 to 38. This combination of unequal surfaces prevents that the moved thermal paper 20 gets stuck on the surfaces of the limiting elements 30 to 38 and, on the other hand, prevents damage to the thermal paper 20 and a paper jam possibly caused thereby.

Figure 5:
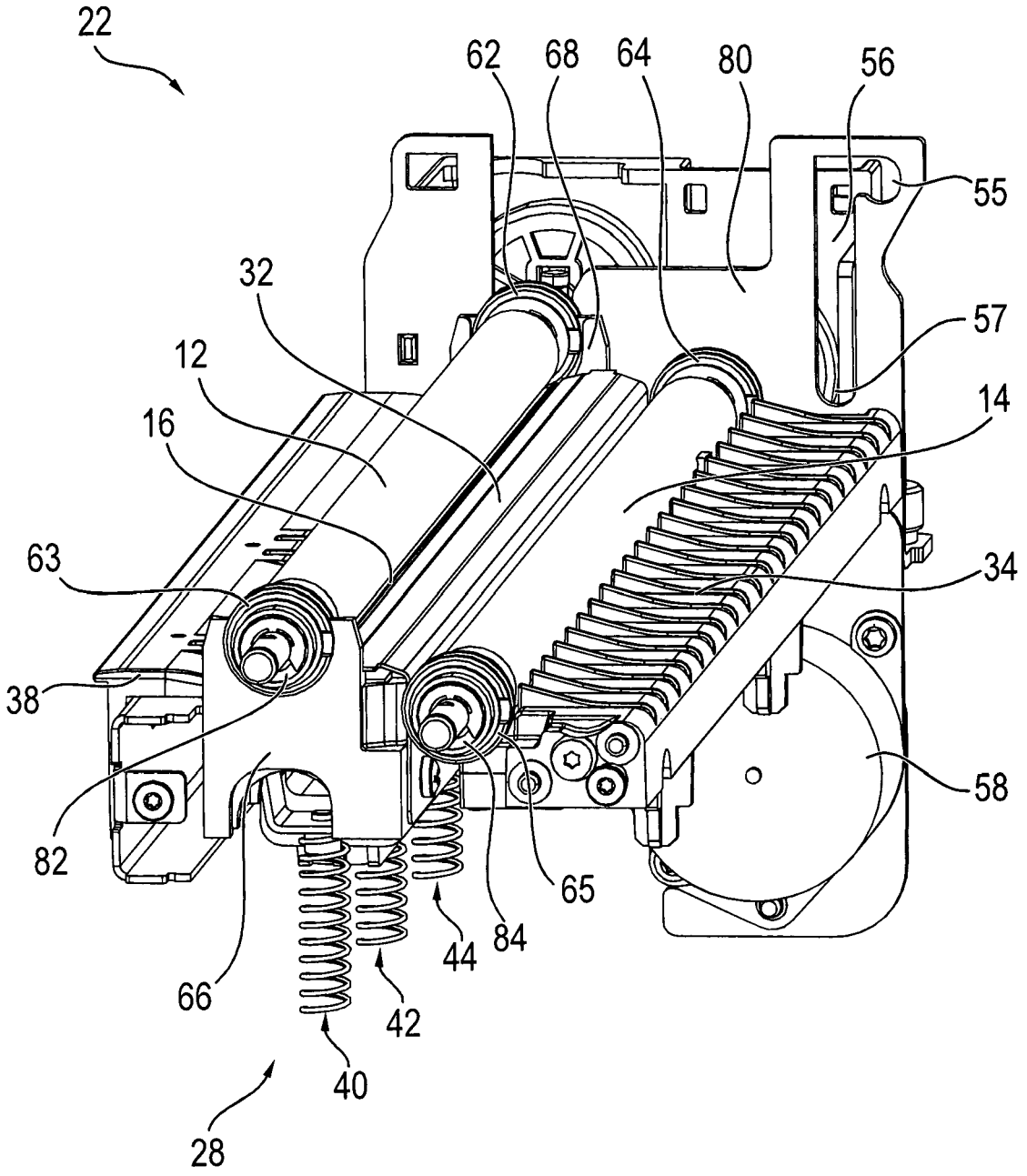
FIG. 5 shows a further perspective view of the second unit of the printing module according to FIGS. 2 to 4.

FIG. 5 shows a further perspective view of the second unit 22. In this view, the second chassis 78 is not illustrated. The guiding elements 66, 68 which are firmly connected to the second print head 16 have a slot. The sides of the guiding element 66, 68 delimiting the slot engage with a groove provided in the circumferential surface of the second bearings 62, 63 in the print mode. As a result thereof, the movement of the second print head 16 relative to the second counter-pressure roller 12 is guided so that it is guaranteed that the thermal line of the second print head 16 is pressed against the second counter-pressure roller 12. This allows a movement of the second print head 16 in the print mode as a result of the pressure forces generated by the spring element 28. Thus, the spring element 28 presses the thermal paper 20 against the second counter-pressure roller 12 with the aid of the second print head 16 and thus it presses the thermal line of the print head 16 against the thermal paper 20. The spring element 28 comprises four coil springs, of which the coil springs 40, 42, 44 are shown in FIG. 5, and which are uniformly distributed over the width of the printing area of the second print head 16.

In addition, two second guide bearings 64, 65 are provided which are arranged at the end regions of the first counter-pressure roller 14. Two further guiding elements 74, 76 are connected to the first print head 18 and each have a slot. The sides of the guiding element 74, 76 delimiting the slot engage with a groove provided in the circumferential surface of the second bearings 64, 65 in the print mode. As a result thereof, the movement of the first print head 18 relative to the first counter-pressure roller 14 can be guided in the print mode in the same manner as this has already been described for the second print head 16 and the second counter-pressure roller 12.

FIG. 6 shows a perspective illustration of the first unit 24. One stop element 60, 61 each, integrated in the limiting element 30, serves to restrict the movement of the second counter-pressure roller 12 in the slots of the guiding elements 66, 68 in the direction of the first unit 24 in the print mode. By this restriction, preferably the position of the second counter-pressure roller 12 in an opening delimited by the slots of the guiding elements 66, 68 and the stop elements 60, 61 is fixed.

As already described in connection with FIG. 3, the pin 72 of the first unit 24 engages with the oblong hole guide 56 in the first chassis 80 of the second unit 22. The first unit 24 has a second pin 70 which engages with the oblong hole guide 86 in the second chassis 78. The combination of oblong hole guides 56, 86 and pins 70, 72 allows a parallel guidance of the movement of the first unit 24 relative to the second unit 22 when changing between the printing position and the maintenance position.

As shown in FIG. 6, the guiding elements 74, 76 are firmly connected to the first print head 18 and have slots. In the print mode or in the printing position, the sides of the guiding element 74, 76 delimiting the slot engage with the grooves provided in the circumferential surfaces of the second bearings 64, 65 and guide the thermal line of the first print head 18 relative to the first counter-pressure roller 14. By the engagement of the sides of the guiding elements 74, 76 firmly connected to the first print head 18 with the grooves of the second bearings 64, 65, further the play of the first print head 18 and of the first counter-pressure roller 14 is restricted in transport direction of the thermal paper 20.

Figure 7:
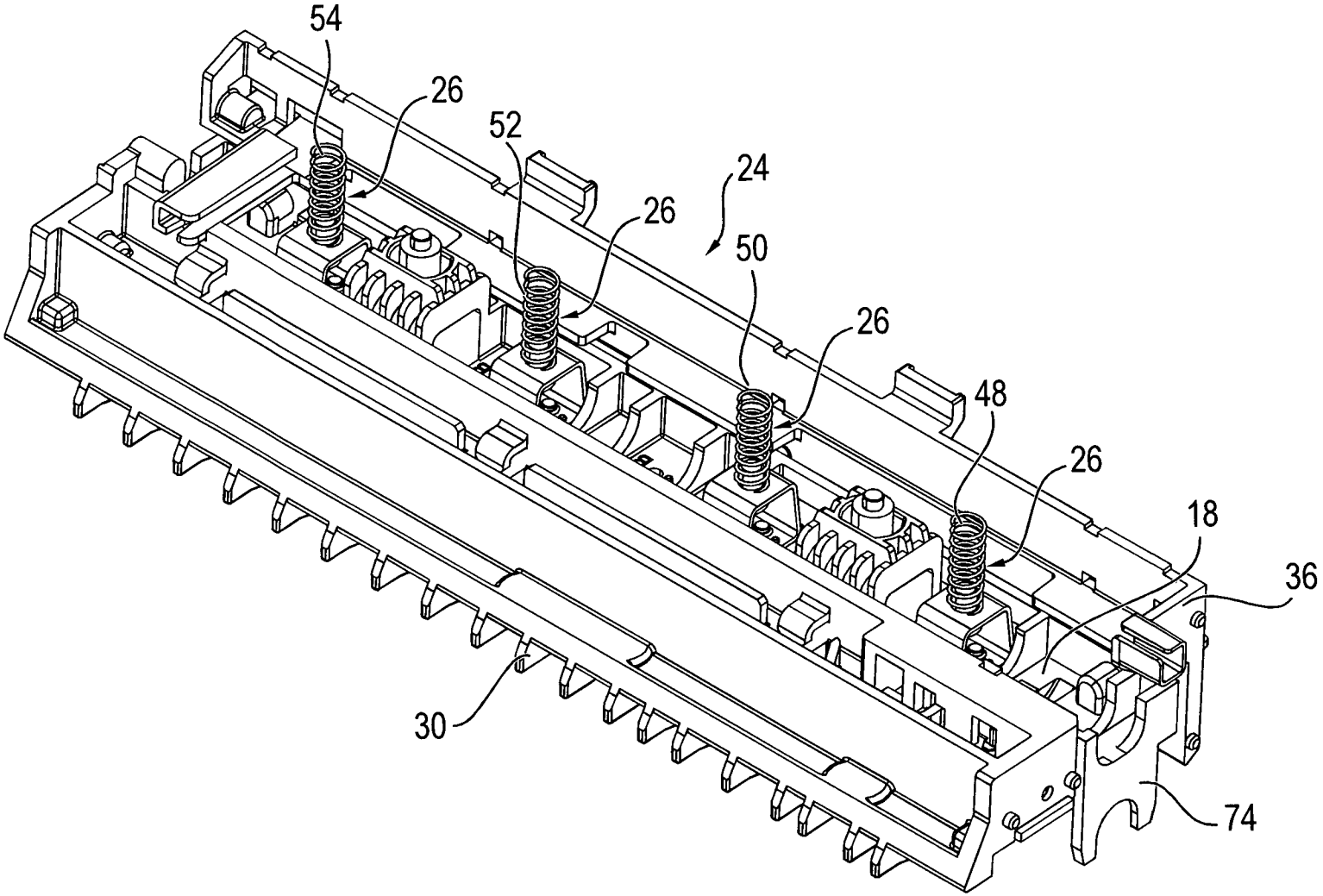
FIG. 7 shows a further perspective view of the first unit according to FIGS. 2 to 6.

FIG. 7 shows a further perspective view of the first unit 24 according to FIG. 6 in which all four coil springs 48 to 54 of the spring element 26 which contact the first print head 18 at its side facing away from the thermal paper 20 are visible.

In other embodiments, each of the spring elements 26, 28 can also comprise more or less individual springs 40 to 54. Alternatively or additionally to the coil springs 40 to 54, also other elastically deformable elements, such as leaf springs or plastic blocks, in particular elastomer blocks, can be used.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The invention claimed is:

1. An apparatus for double-sided printing of thermal paper, comprising:

a first print head for printing the front side of the thermal paper and a second print head for printing the back side of the thermal paper, a first counter-pressure element lying opposite to the first print head, a second counter-pressure element lying opposite to the second print head, a first unit which can be moved relative to a second unit, the first print head being arranged in the first unit, and the second print head, the first counter-pressure element and the second counter-pressure element being arranged in the second unit, wherein the apparatus is configured to guide the thermal paper between the first print head and the first counter-pressure element and between the second print head and the second counter-pressure element.

2. The apparatus according to claim 1, wherein the counter-pressure elements are counter-pressure rollers.

3. The arrangement apparatus according to claim 2, wherein the counter-pressure rollers are configured to be driven in opposite directions relative to each other at the same speed and to exert a force on the thermal paper in the direction of transport in which the thermal paper can be transported through the apparatus during a printing operation.

4. The apparatus according to claim 1, wherein each print head comprises at least one thermal line configured to change a color of the thermal paper selectively.

5. The apparatus according to claim 1, wherein each print head has at least one spring element associated therewith, which spring element is configured to exert a pressure force on the print head in the direction of the counter-pressure element lying opposite to the respective print head.

6. The apparatus according to claim 1, wherein the first unit and the second unit have a first position relative to each other in a print mode, and that the first unit and the second unit have a second position relative to each other in a maintenance mode.

7. The apparatus according to claim 6, wherein a pressure force between the first counter-pressure element and the first print head in the maintenance mode is reduced compared to the pressure force between the first counter-pressure element and the first print head in the print mode, and/or a pressure force between the second counter-pressure element and the second print head in the maintenance mode is reduced compared to the pressure force between the second counter-pressure element and the second print head in the print mode.

8. The apparatus according to claim 6, wherein the second counter-pressure element can be removed from the second unit in the maintenance mode.

9. The apparatus according to claim 1, wherein a position of the first unit relative to the second unit is fixed with the aid of a locking element in a print mode, a pressure force being exerted between the first counter-pressure element and the first print head as well as between the second counter-pressure element and the second print head, and the first counter-pressure element being held in a predetermined position in the second unit with the aid of the first unit.

10. The apparatus according to claim 6, wherein a guide configured to guide the first unit when the first unit moves between its first position and its second position is provided.

11. The apparatus according to claim 10, wherein the guide comprises at least one hinge and at least one oblong hole and at least one engagement element wherein the engagement element engages with the oblong hole.

12. The apparatus according to claim 11, wherein the oblong hole has a first leg and a second leg, the two legs being angled relative to each other and each of the two legs comprising a first end region at which the two legs are connected to each other and a second end region, means being provided which hold the engagement element connected to the first unit in the second end region of the first leg of the oblong hole in the maintenance mode.

13. The apparatus according to claim 1, wherein the second counter-pressure element comprises a first end region and a second end region, the first end region lying positioned opposite to the second end region and a third region being arranged between the two end regions, on which third region a pressure force is exerted via the second print head in the print mode, each of the first and the second end regions of the counter-pressure element being receivable in an opening provided in the second unit, each of the openings being open at the side facing the first unit in the print mode.

14. The apparatus according to claim 2, wherein each end region of the second counter-pressure roller is mounted with the aid of at least one bearing unit each, each of the bearing units being received in one of the openings in the print mode.

15. The apparatus according to claim 14, wherein in which each bearing unit comprises a first bearing element that can be received in a chassis of the apparatus and at least one second bearing element, at a circumferential surface of which a groove is provided into which sides delimiting a slot in a guiding element can be received, wherein the combination of groove and slot allows a relative motion of the slot or, respectively of the guiding element with respect to the second bearing element, the guiding element being firmly connected to a print head.

* * * * *